US011125235B2

(12) United States Patent
Sivagnanasundaram

(10) Patent No.: US 11,125,235 B2
(45) Date of Patent: Sep. 21, 2021

(54) CENTRIFUGAL COMPRESSOR WITH DIFFUSER WITH THROAT

(71) Applicant: Cummins Ltd., Huddersfield (GB)

(72) Inventor: Subenuka Sivagnanasundaram, Huddersfield (GB)

(73) Assignee: Cummins Ltd., Huddersfield (GB)

( * ) Notice: Subject to any disclaimer, the term of this patent is extended or adjusted under 35 U.S.C. 154(b) by 43 days.

(21) Appl. No.: 16/314,170

(22) PCT Filed: Jun. 29, 2017

(86) PCT No.: PCT/GB2017/051893
§ 371 (c)(1),
(2) Date: Dec. 31, 2018

(87) PCT Pub. No.: WO2018/002618
PCT Pub. Date: Jan. 4, 2018

(65) Prior Publication Data

US 2019/0219057 A1 Jul. 18, 2019

(30) Foreign Application Priority Data

Jun. 30, 2016 (GB) ..... 1611439

(51) Int. Cl.
*F04D 17/10* (2006.01)
*F04D 29/44* (2006.01)

(52) U.S. Cl.
CPC ..... *F04D 17/10* (2013.01); *F04D 29/441* (2013.01); *F05D 2250/16* (2013.01);
(Continued)

(58) Field of Classification Search
CPC ..... F04D 29/44; F04D 29/441; F04D 17/10; F02C 6/12
See application file for complete search history.

(56) References Cited

U.S. PATENT DOCUMENTS 3,289,921 A 12/1966 Soo
3,997,281 A * 12/1976 Atkinson ..... F04D 29/444 415/207

(Continued)

FOREIGN PATENT DOCUMENTS

CH 211998 A 5/1939
CN 101057079 A 10/2007

(Continued)

OTHER PUBLICATIONS

Corrected Search Report issued by the British Intellectual Property Office, dated Dec. 12, 2016 for related Application No. GB1611439.9; 4 pages.

(Continued)

*Primary Examiner* — Woody A Lee, Jr.
*Assistant Examiner* — Jackson N Gillenwaters
(74) *Attorney, Agent, or Firm* — Faegre Drinker Biddle & Reath LLP

(57) ABSTRACT

A diffuser is proposed which is formed as the gap between rotationally-symmetric surfaces which face each other. Moving in the radial direction, the axial extent of the gap generally decreases to a minimum value in a throat portion of the diffuser, and then generally increases again. The distance from the rotational axis of the compressor to the throat may be approximately at least 125% of the radius of the compressor wheel. The inventors have found that a throat at this distance from the rotational axis may lead to higher efficiency at high flow rates, especially for relatively low turbo speeds. This is because the spacing between the compressor wheel and the throat permits diffusion of the gas streams leaving the compressor wheel.

14 Claims, 7 Drawing Sheets

COMPARATIVE EXAMPLE

(52) U.S. Cl.
CPC .. *F05D 2250/323* (2013.01); *F05D 2250/324* (2013.01); *F05D 2250/52* (2013.01); *F05D 2250/71* (2013.01); *F05D 2250/711* (2013.01)

(56) References Cited

U.S. PATENT DOCUMENTS

| | | | | |
|---|---|---|---|---|
| 4,382,747 | A | 5/1983 | Okano | |
| 4,900,225 | A * | 2/1990 | Wulf | F04D 29/441 415/224.5 |
| 5,143,514 | A | 9/1992 | Adachi | |
| 8,157,516 | B2 * | 4/2012 | Chen | F04D 29/441 415/206 |
| 8,157,716 | B2 | 4/2012 | Madsen | |
| 2004/0109757 | A1 | 6/2004 | Nenstiel | |
| 2016/0076553 | A1 * | 3/2016 | Bessho | F04D 17/10 415/204 |
| 2016/0097297 | A1 | 4/2016 | Twist et al. | |
| 2018/0073520 | A1 * | 3/2018 | Soeguet | F04D 29/056 |
| 2020/0063753 | A1 * | 2/2020 | Higashimori | F04D 29/441 |
| 2020/0109719 | A1 * | 4/2020 | Fujiwara | F04D 29/44 |

FOREIGN PATENT DOCUMENTS

| | | | | |
|---|---|---|---|---|
| CN | 201159212 | Y | 12/2008 | |
| DE | 3148756 | A1 | 7/1983 | |
| DE | 102013017694 | A1 | 7/2014 | |
| DE | 102015103615 | A1 * | 4/2016 | F04D 29/441 |
| DE | 102015103615 | A1 | 4/2016 | |
| EP | 0341553 | A1 | 11/1989 | |
| GB | 1153345 | A | 5/1969 | |
| GB | 1560454 | A | 2/1980 | |
| JP | H03260399 | A | 11/1991 | |
| JP | H11294392 | A | 10/1999 | |
| KR | 0118863 | B1 | 9/1997 | |
| KR | 20110057736 | A | 6/2011 | |
| WO | 0198669 | A1 | 12/2001 | |
| WO | 2006018591 | A1 | 2/2006 | |

OTHER PUBLICATIONS

International Search Report and Written Opinion issued by the European Patent Office, dated Sep. 14, 2017, for International Application No. PCT/GB2017/051893; 9 pages.

First Office Action issued by the Chinese Patent and Trademark Office (summary of action translated to English language), dated Apr. 10, 2020, for Chinese Application No. 201780047601.X; 9 pages.

* cited by examiner

COMPARATIVE EXAMPLE

CENTRIFUGAL COMPRESSOR WITH DIFFUSER WITH THROAT

RELATED APPLICATIONS

The present application is a National Stage Application under 35 USC § 371 of International Application No. PCT/GB2017/051893, titled CENTRIFUGAL COMPRESSOR WITH DIFFUSER WITH THROAT, filed Jun. 29, 2017, which claims priority to British Application No. 1611439.9, filed with the United Kingdom Intellectual Property Office on Jun. 30, 2016, the entire disclosures of which being hereby expressly incorporated herein by reference.

FIELD OF THE INVENTION

The present invention relates to a turbomachine comprising a centrifugal compressor stage, and in particular to the diffuser of the compressor.

BACKGROUND OF THE INVENTION

Turbomachines are machines that transfer energy between a rotor and a fluid. For example, a turbomachine may transfer energy from a fluid to a rotor or may transfer energy from a rotor to a fluid. Two examples of turbomachines are a power turbine, which uses the rotational energy of a rotor driven by a fluid to do useful work, for example, generating electrical power; and a compressor which uses the rotational energy of the rotor to compress a fluid.

Turbochargers are well known turbomachines for supplying air to an inlet of an internal combustion engine at pressures above atmospheric pressure (boost pressures). A conventional turbocharger essentially comprises an exhaust gas driven turbine wheel mounted on a rotatable shaft within a turbine housing connected downstream of an engine outlet manifold. Rotation of the turbine wheel rotates a compressor wheel mounted on the other end of the shaft within a compressor housing. The compressor wheel delivers compressed air to an engine inlet manifold.

The turbocharger shaft is conventionally supported by journal and thrust bearings, including appropriate lubricating systems, located within a central bearing housing connected between the turbine and compressor wheel housings.

FIG. 1 shows a schematic cross-section through a known turbocharger. The turbocharger comprises a turbine 11 joined to a compressor 12 via a central bearing housing 13. The turbine 11 comprises a turbine wheel 14 for rotation within a turbine housing 15. Similarly, the compressor 12 comprises a compressor wheel 16 (or "impeller") which can rotate within a compressor housing 17. The compressor housing 17 defines a compressor chamber 38 which is largely filled by the compressor wheel 16, and within which the compressor wheel 16 can rotate. The turbine wheel 14 and compressor wheel 16 are mounted on opposite ends of a common turbocharger shaft 18 which extends through the central bearing housing 13. The turbocharger shaft 18 is rotatably supported by a bearing assembly in the bearing housing 13 which comprises two journal bearings 34 and 35 housed towards the turbine end and compressor end respectively of the bearing housing 13. The bearing assembly further includes a thrust bearing 36.

The turbine housing 15 has at least one exhaust gas inlet volute 19 (in FIG. 1 two volutes are shown) located annularly around the turbine wheel 14, and an axial exhaust gas outlet 10. The compressor housing 17 has an axial air intake passage 31 and a volute 32 arranged annularly around the compressor chamber 38. The volute 32 is in gas flow communication with a compressor outlet 33. The compressor chamber 38 is connected to the volute 32 by a radially-extending diffuser space 39 (also referred to here as a "diffuser") which is a gap between a radially-extending shroud surface 20 of the housing 17, and a radially extending hub surface 21 of the bearing housing 13. The diffuser 39 is rotationally symmetric about the rotational axis of the shaft 18.

In use, the turbine wheel 14 is rotated by the passage of exhaust gas from the exhaust gas inlet volute 19 to the exhaust gas outlet 10. Exhaust gas is provided to the exhaust gas inlet volute 19 from an exhaust manifold (also referred to as an outlet manifold) of the engine (not shown) to which the turbocharger is attached. The turbine wheel 14 in turn rotates the compressor wheel 16 which thereby draws intake air through the compressor inlet 31 and delivers boost air to an inlet manifold of the engine via the diffuser 39, the volute 32 and then the outlet 33.

SUMMARY OF THE INVENTION

The invention aims to provide a new and useful diffuser for the compressor of a turbomachine.

In general terms, the invention proposes that in a diffuser formed as the gap between rotationally-symmetric surfaces which face each other, the axial extent of the gap varies in the radial direction. Specifically, moving in the radial direction, the axial extent of the gap generally decreases to a minimum value in a portion of the diffuser referred to as a "throat portion" (or just "throat"), and then generally increases again.

The distance from the rotational axis of the compressor to the throat may be at least approximately 125% of the radius of the compressor wheel, and no more than approximately 160% of the radius of the compressor wheel. In computation simulations, it has been found that a throat at this distance from the rotational axis may lead to higher efficiency at high flow rates, especially for relatively low turbo speeds. This is because the spacing between the compressor wheel and the throat permits diffusion of the gas streams (including the jet and the wake) leaving the compressor wheel. Furthermore, the increasing axial extent of the gap radially outwardly the throat portion (i.e. in the portion of the diffuser between the throat and the scroll) reduces turbulence at the transition between the diffuser and the scroll.

Increasing the radial distance between the rotational axis and the throat still further tends to lead to increased efficiently at high flow rates for a higher range of turbo speeds. On the other hand, the greatest levels of efficiency improvement for low turbo speeds are obtained when the radial distance between the rotational axis and the throat is not that high. In other words, there may be a trade-off between increasing the range of turbo speeds at which higher efficiency is obtained, and increasing the efficiency improvement at low turbo speeds.

The diffuser may be formed as the gap between a planar, axially-facing hub surface, and a curved surface of the shroud wall facing towards the hub surface. In a cross-section of the shroud in a plane including the rotational axis, the shroud surface defining one side of the diffuser may appear as a smooth curve (i.e. without positions at which the tangent to the shroud surface varies discontinuously). The shroud wall may be convex as viewed in this plane. For example, the curve may a parabola.

Radially-inwardly of the throat, the diffuser has a radially-inner portion in which the axial extent of the gap is greater than that of the throat. In this radially-inner portion, the axial extent of the gap may decrease monotonously at successive radially-outward positions towards the throat. The radially-inner portion of the diffuser may be spaced from the compressor wheel.

Radially-outwardly of the throat portion, the diffuser has a radially-outer portion extending to the scroll, in which the axial extent of the gap is greater than that of the throat. In this radially-outer portion of the diffuser, the axial extent of the gap increases monotonously at successively radially-outward positions towards the scroll. At the transition between the diffuser and the scroll, the shroud surface is preferably rounded, to minimise turbulence.

The throat portion of the diffuser may have no radial extent, i.e. it is a single throat position where the radially-inner and radially-outer portions of the diffuser meet.

In this document a surface of a first object is said to "face towards" a second object if the normal direction out of the surface of the first object has a positive component in the separation direction of the objects (i.e. the direction in which the respective points on the two objects which are closest to each other, are spaced apart), and "face away" from the second object if the normal direction out of the surface has a negative component in the separation direction. The term "face" does not imply that the normal to the surface is parallel to the separation direction. A surface is said to be "radially-extending" if the normal to the surface has a component in the axial direction.

BRIEF DESCRIPTION OF THE DRAWINGS

A non-limiting embodiment of the invention will now be described, for the sake of example only, with reference to the following figures, in which.

DETAILED DESCRIPTION OF THE EMBODIMENTS

Figure 1:
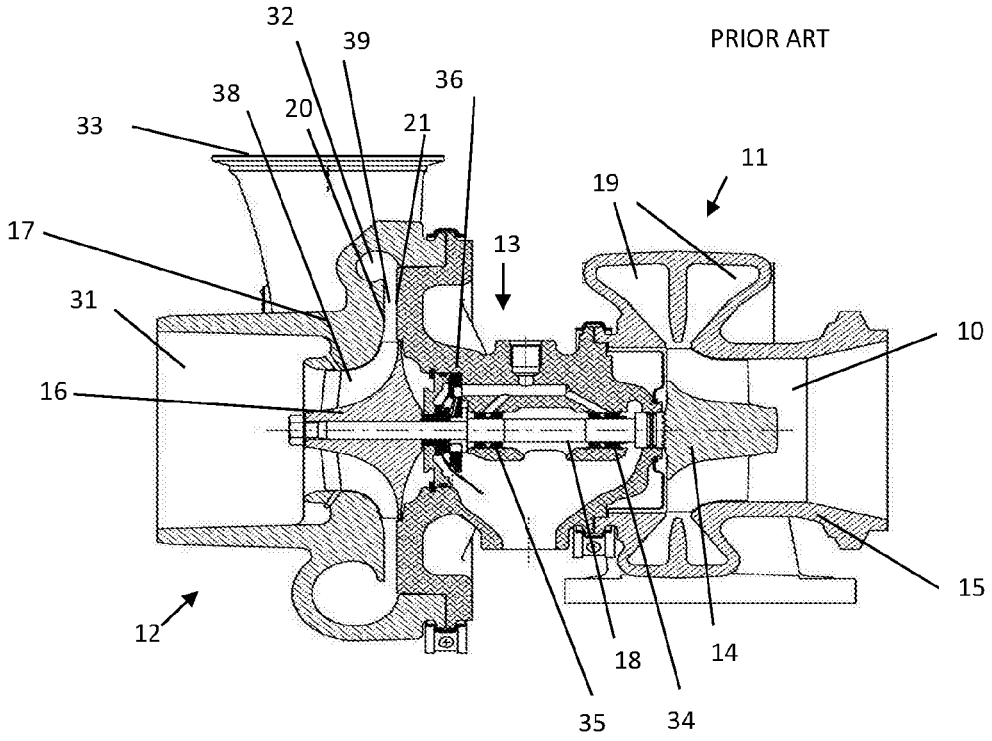
FIG. 1 is a cross-sectional drawing of a known turbocharger.
Figure 2:
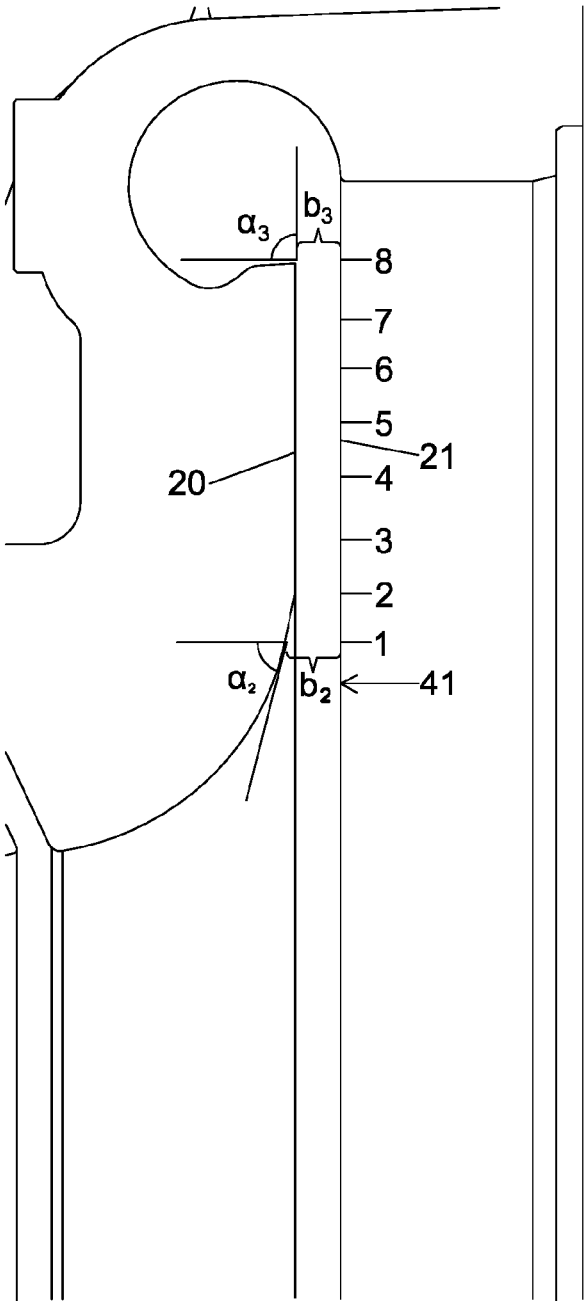
FIG. 2 shows a baseline configuration for a diffuser.

Referring firstly to FIG. 2, a baseline configuration is shown for the diffuser 39 of the turbocharger of FIG. 1. The baseline configuration is a comparative example used below in computational simulation comparisons with embodiments of the invention.

Eight radially-spaced reference positions in the diffuser are marked 1-8 in FIG. 2. Table 1 shows the radial position of these reference positions, measured from the centre of the rotational axis of the shaft 18. The radial position of the radially outer tip of the blades of the compressor wheel 16 (not shown) is denoted as 41, and is at a distance 54 mm from the rotational axis of the shaft 18.

TABLE 1

| Reference | Radial distance from the axis of the shaft 18 | | Radial distance of reference point from the next reference point in the radially-inward |
|---|---|---|---|
| position | mm | % of wheel diameter | direction (mm) |
| 1 | 57.5 | 106.481 | — |
| 2 | 62.45 | 115.648 | 4.95 |
| 3 | 67.4 | 124.815 | 4.95 |
| 4 | 72.35 | 133.981 | 4.95 |
| 5 | 77.3 | 143.148 | 4.95 |
| 6 | 82.25 | 152.315 | 4.95 |
| 7 | 87.25 | 161.574 | 5 |
| 8 | 92.86 | 171.963 | 5.61 |

The reference position 1 of the diffuser of the baseline configuration has a first axial width $b_2$. The diffuser 39 becomes narrower linearly at successive positions in the radially-outward direction, until reference position 2. Then it has substantially constant width until the outlet reference position 8. At the reference position 1, the angle between the tangent to the hub surface 20 (perpendicular to the circumferential direction) and the axial direction is marked as $a_2$. At the outlet position 8, the angle between the tangent to the hub surface (measured in a plane including the rotational axis) and the axial direction is marked as $a_3$, and the axial width at the outlet 8 is denoted by $b_3$.

Figure 3:
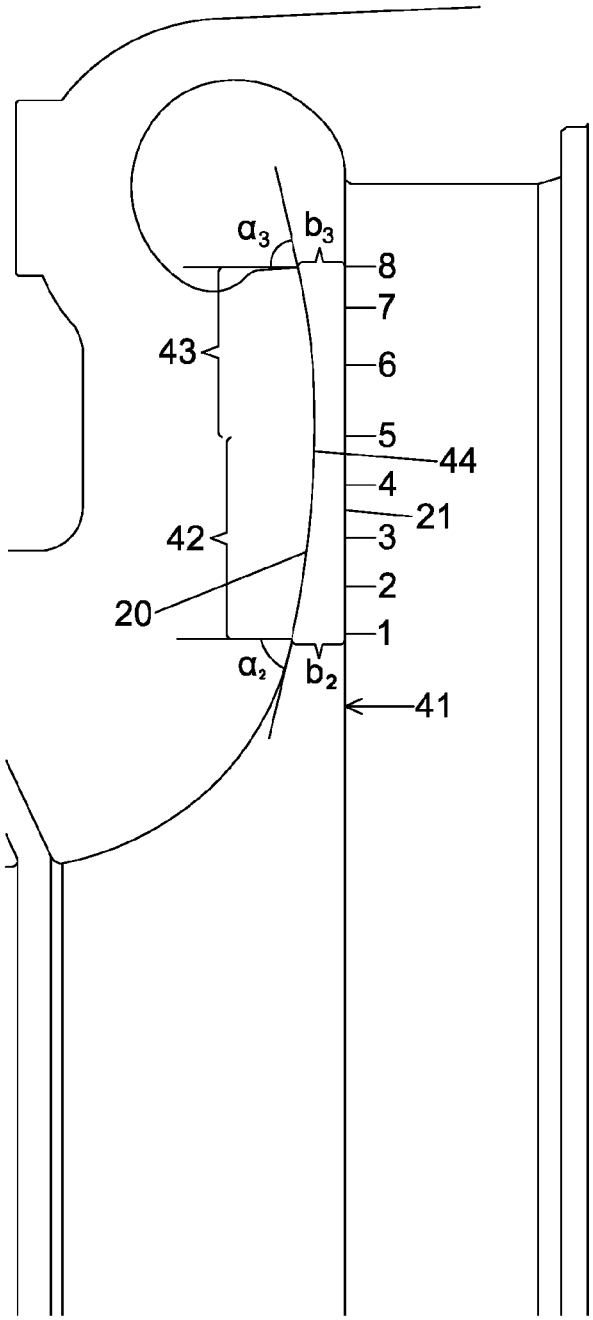
FIG. 3 shows schematically a configuration of a diffuser which is an embodiment of the invention.

By contrast, FIG. 3 shows schematically the shape of the diffuser in certain embodiments of the invention. Distances in FIG. 3 are not drawn to scale, and below we supply distance parameters defining three specific embodiments. In each case, the diffuser is rotationally symmetric about the axis of the shaft, and the reference positions 1 to 8 are in the same radial positions as in the baseline configuration shown in FIG. 2.

The diffuser gap has a narrowest axial extent at a single, radial position 44, referred to as the throat position. The portion of the diffuser which is radially-inward from the throat portion 44 is the radially-inner portion 42. The portion of the diffuser which is radially-outward from the throat portion 44, and extends to the scroll, is the radially-outer portion 43. The radially-inner portion 42 and radially-outer portion 43 of the gap touch at the throat position 44 because the throat position 44 has no radial extent.

However, more generally, there may be a range of radial positions at which the gap has the same, minimal axial extent. In other words, the diffuser has a throat portion which may have any radial extent. Throughout the throat portion, all positions on the shroud surface 20 are axially spaced by this same axial distance from respective positions on the hub surface 21. The throat portion spaces the radially-inner portion of the diffuser radially from the radially-outer portion.

The arrangement of FIG. 3 may be considered as a limiting case of this, in which the throat portion has zero radial extent: the portion of the shroud surface 20 which is closest to the hub surface 21 is just a circular line at the throat position 44. In other words, in the arrangement of FIG. 3, the throat portion of the gap is the single, radial throat position 44.

We now turn to more precise definitions of the parameters of the baseline configuration of FIG. 2, and the three embodiments with the general shape shown schematically in FIG. 3.

As in the baseline configuration, in all three embodiments the compressor wheel 16 has a diameter of 108 mm, i.e. a radius of 54 mm. Table 2 shows further parameters which are in common between the baseline configuration and the three embodiments. The impeller tip width means the axial length of the blades of the compressor wheel 6 at their radially-outer point. The radially-outer edge of the blade has equal distance from the rotational axis along the whole length of the blade. As mentioned above, the diffuser inlet width $b_2$ is the axial width of the diffuser at the reference position 1. The diffuser length is the radial distance from the reference position 1 to the outlet reference position 8. The inlet angle $\alpha_2$ is the angle between the tangent to the hub surface 20 at the reference position 1, and the axial direction.

TABLE 2

| Parameter | |
|---|---|
| Impeller Tip width (mm) | 6.13 |
| Diffuser Inlet width (mm) b2 | 5.4 |
| Diffuser Length (mm) L | 35.4 |
| Diffuser Inlet angle $\alpha_2$ | 77.5 |

Table 3 shows other parameters of the baseline configuration and the three embodiments, while Table 4 shows the axial width of the baseline configuration and the three embodiments at each of the radial positions 1 to 8.

TABLE 3

| Model | Outlet angle (deg) $\alpha_3$ | Outlet gap (mm) b3 | Minimum axial extent of the gap at the throat position 44 (mm) | Minimum axial extent of the gap as a % of the impeller tip width | Radial position of minimum gap (mm) | Normalised radial position of minimum gap | Ratio of the distance from the rotational axis to throat position, to the distance of from the rotational axis to the radially-outer edge of diffuser |
|---|---|---|---|---|---|---|---|
| Baseline | 90 | 4.318 | 4.318 | 70.4 | 62.45 | 116% | 67.3% |
| Embodiment 1 | 46.5 | 6.13 | 4.37 | 71.3 | 74.8 | 139% | 80.6% |
| Embodiment 2 | 77.5 | 6.13 | 4.88 | 79.6 | 70.1 | 130% | 75.5% |
| Embodiment 3 | 62 | 4.905 | 4.02 | 65.6 | 81.5 | 151% | 87.7% |

TABLE 4

| | Baseline | | DOE2 | | DOE4 | | DOE13 | |
|---|---|---|---|---|---|---|---|---|
| Reference Reference point | Diff gap | Diff gap % of the wheel tip width | Diff gap | Diff gap % of the wheel tip width | Diff gap | Diff gap % of the wheel tip width | Diff gap | Diff gap % of the wheel tip width |
| 1 | 5.42 | 88.418 | 5.42 | 88.418 | 5.42 | 88.418 | 5.42 | 88.418 |
| 2 | 4.32 | 70.473 | 4.75 | 77.488 | 4.97 | 81.077 | 4.72 | 76.998 |
| 3 | 4.32 | 70.473 | 4.48 | 73.083 | 4.88 | 79.608 | 4.36 | 71.126 |
| 4 | 4.32 | 70.473 | 4.38 | 71.452 | 4.91 | 80.098 | 4.14 | 67.537 |
| 5 | 4.32 | 70.473 | 4.42 | 72.104 | 5.01 | 81.729 | 4.04 | 65.905 |
| 6 | 4.32 | 70.473 | 4.6 | 75.041 | 5.2 | 84.829 | 4.04 | 65.905 |
| 7 | 4.32 | 70.473 | 4.97 | 81.077 | 5.49 | 89.560 | 4.18 | 68.189 |
| 8 | 4.32 | 70.473 | 5.97 | 97.390 | 6.08 | 99.184 | 4.83 | 78.793 |

Figure 4:
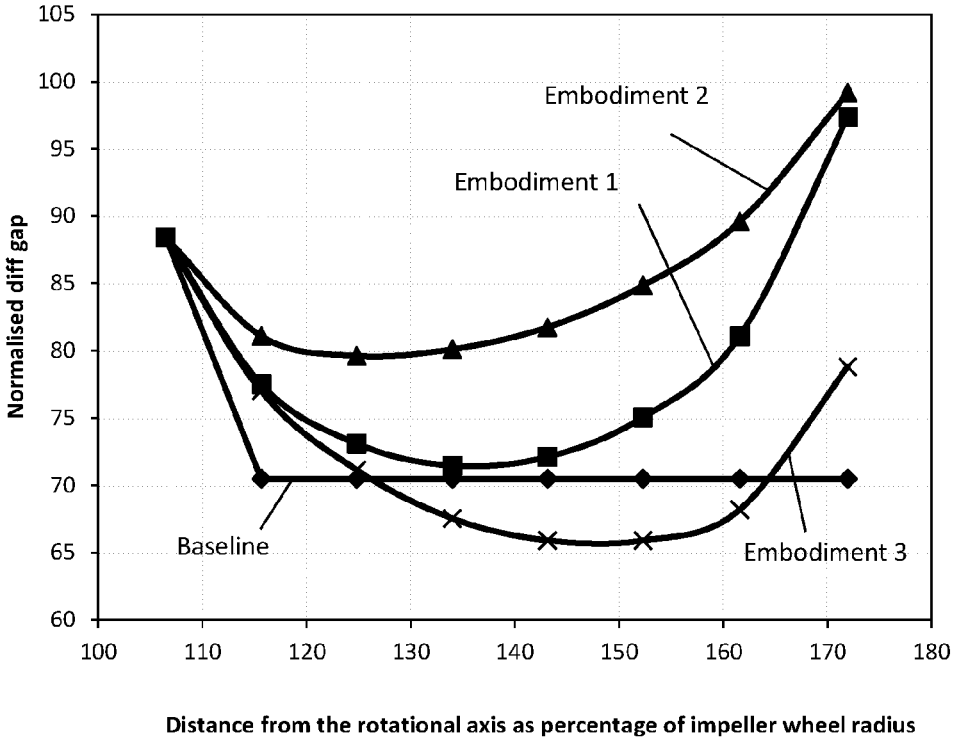
FIG. 4 shows the configuration of three embodiments of the invention compared to the baseline configuration.

FIG. 4 shows the axial width of the baseline configuration and the three embodiments at each of the positions 1 to 8, according to table 4.

Figure 5A:
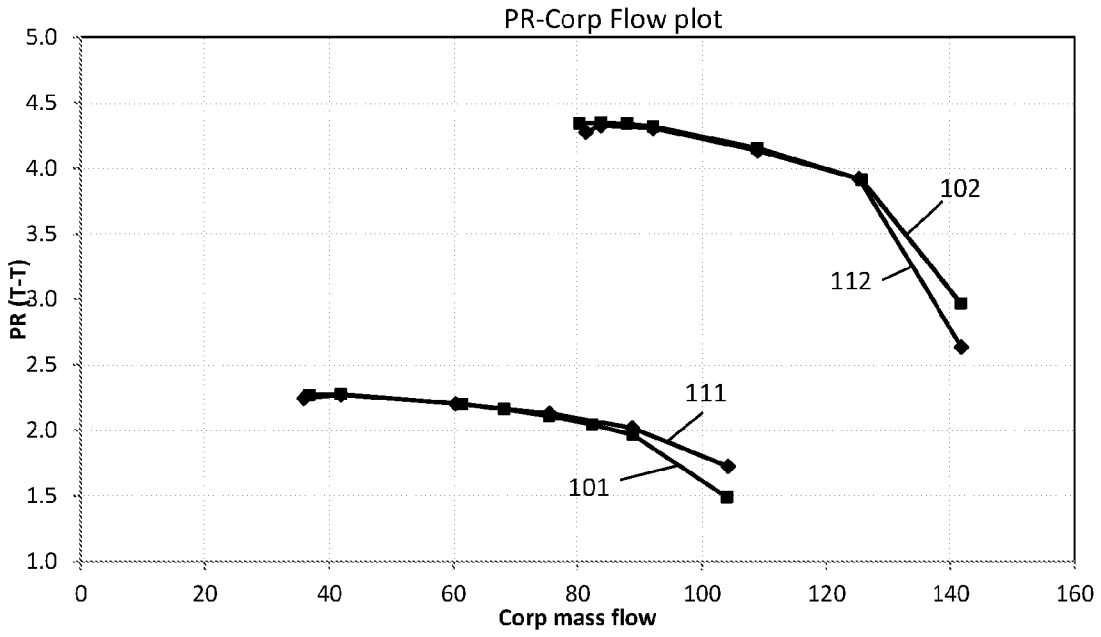
FIG. 5 is composed of FIG. 5(*a*) which shows the pressure ratio (inlet to outlet), and FIG. 5(*b*) which shows the efficiency, as a function of the mass flow for the first of the embodiments.
Figure 5B:
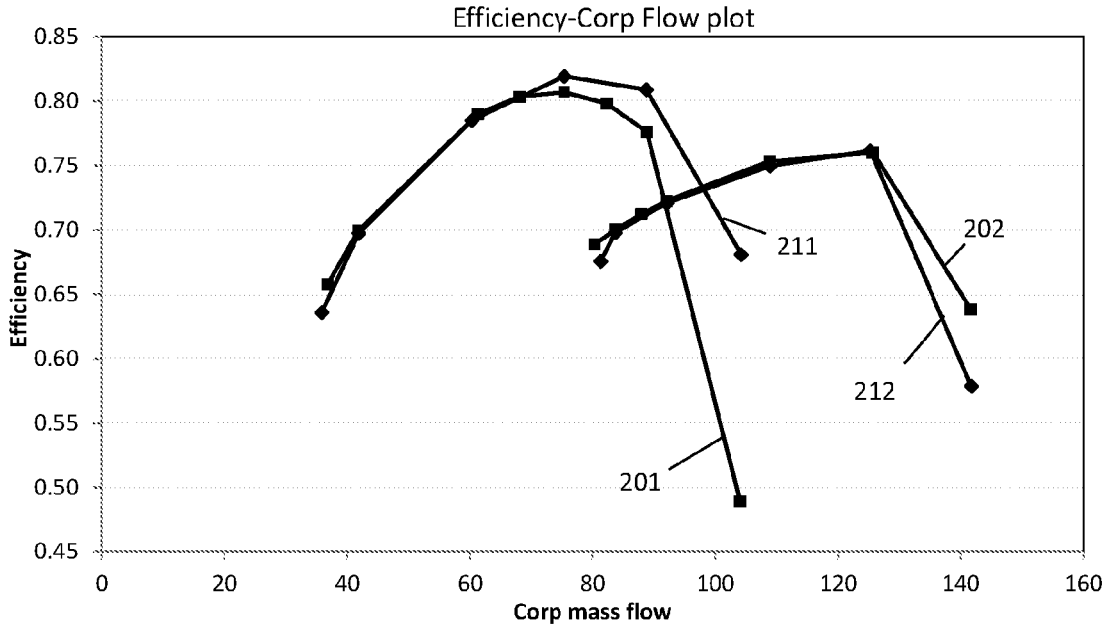

FIG. 5(*a*) shows the relationship between the pressure ratio at the inlet and outlet, and the corporate mass flow for the base configuration and for embodiment 1. Corporate mass flow (shown as "corp mass flow" in FIGS. 5-7) is used here to mean the mass flow corrected for the inlet temperature and pressure. Line 101 shows the relationship for the baseline configuration, and a turbo speed of 65 k revolutions-per-minute (rpm). Line 102 shows the relationship for the baseline configuration, and a turbo speed of 95 k rpm. Line 111 shows the relationship for embodiment 1, and a turbo speed of 65 k rpm. Line 112 shows the relationship for embodiment 1, and a turbo speed of 95 k rpm. It can be seen that the pressure ratio is hardly different between embodiment 1 and the baseline configuration, except at the highest mass flows.

FIG. 5(*b*) shows the efficiency as a function of corporate mass flow for the base configuration and for embodiment 1. Line 201 shows the relationship for the baseline configuration, and a turbo speed of 65 k rpm. Line 202 shows the relationship for the baseline configuration, and a turbo speed of 95 k rpm. Line 211 shows the relationship for the embodiment 1, and a turbo speed of 65 k rpm. Line 212 shows the relationship for embodiment 1, and a turbo speed of 95 k rpm. It can be seen that for low flow rates the baseline configuration and embodiment 1 have similar levels of efficiency. However, at the low turbo speed (65 k rpm), embodiment 1 is much more efficient than the baseline configuration for high flow rates. At the high turbo speed (95 rpm), embodiment 1 is slightly less efficient for high flow rates.

Figure 6A:
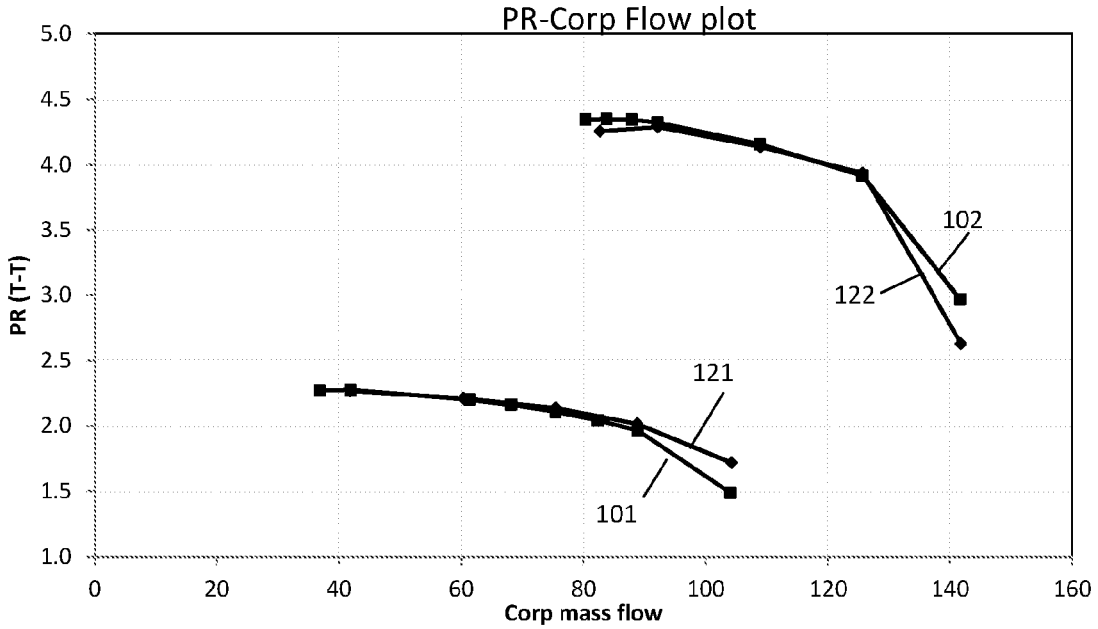
FIG. 6 is composed of FIG. 6(*a*) which shows the pressure ratio (inlet to outlet), and FIG. 6(*b*) which shows the efficiency, as a function of the mass flow for the second of the embodiments.
Figure 6B:
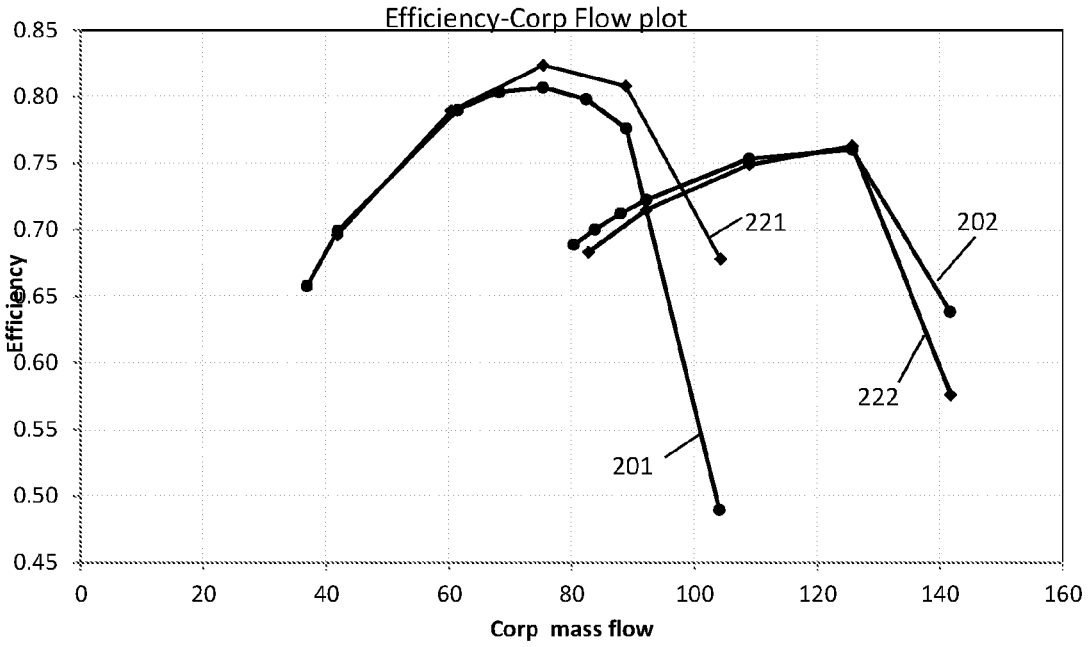

FIG. 6(*a*) shows the relationship between the pressure ratio at the inlet and outlet, and the corporate mass flow for the base configuration and for embodiment 2. Line 101 shows the relationship for the baseline configuration, and a turbo speed of 65 k rpm. Line 102 shows the relationship for the baseline configuration, and a turbo speed of 95 k rpm. Line 121 shows the relationship for embodiment 2, and a speed of 65 k rpm. Line 122 shows the relationship for embodiment 2, and a turbo speed of 95 k rpm. It can be seen that the pressure ratio is hardly different between embodiment 2 and the baseline configuration, except at the highest mass flows.

FIG. 6(*b*) shows the efficiency as a function of corporate mass flow for the base configuration and for embodiment 2. Line 201 shows the relationship for the baseline configuration, and a turbo speed of 65 k rpm. Line 202 shows the relationship for the baseline configuration, and a turbo speed of 95 k rpm. Line 221 shows the relationship for the embodiment 2, and a turbo speed of 65 k rpm. Line 222 shows the relationship for embodiment 2, and a turbo speed of 95 k rpm. It can be seen that for low flow rates the baseline configuration and embodiment 2 have similar levels of efficiency. However, at the low turbo speed (65 k rpm), embodiment 2 is much more efficient than the baseline configuration for high flow rates. At the high turbo speed (95 k rpm), embodiment 2 is slightly less efficient for high flow rates.

Figure 7A:
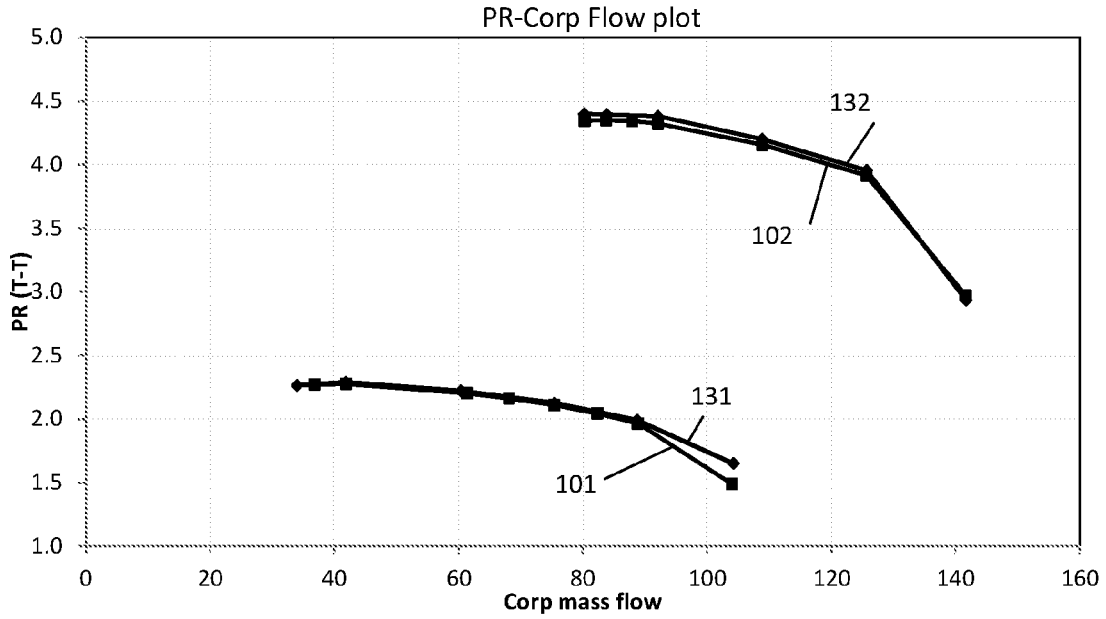
FIG. 7 is composed of FIG. 7(*a*) which shows the pressure ratio (inlet to outlet), and FIG. 7(*b*) which shows the efficiency, as a function of the mass flow for the third of the embodiments.
Figure 7B:
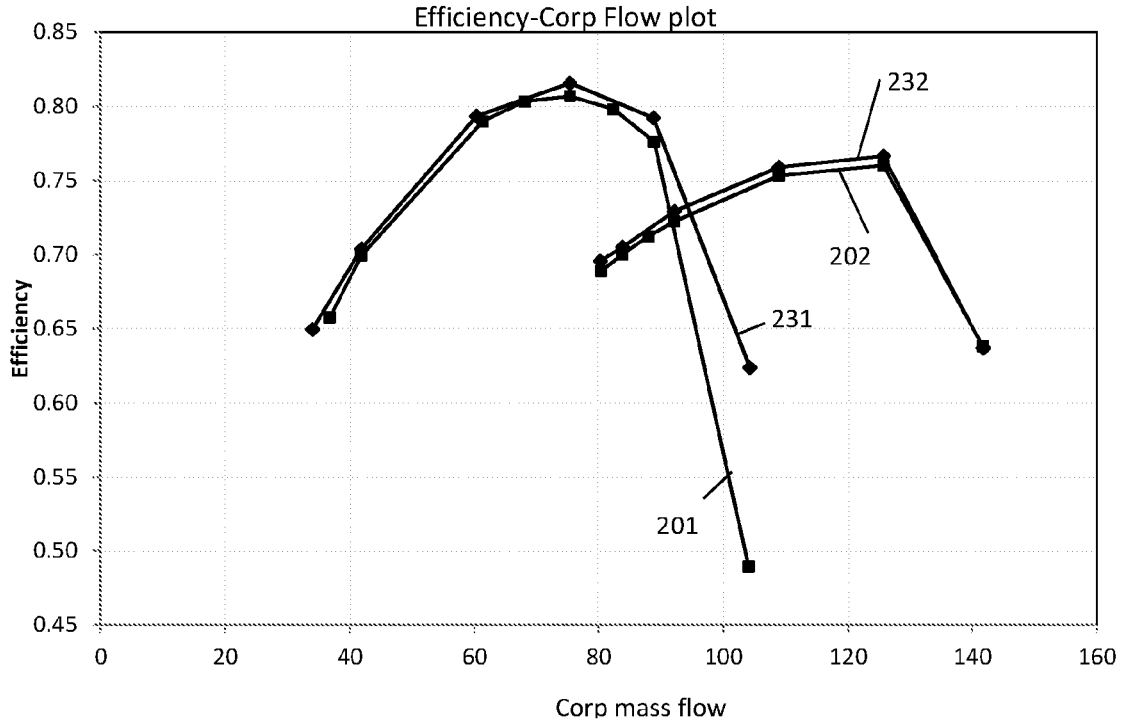

FIG. 7(*a*) shows the relationship between the pressure ratio at the inlet and outlet, and the corporate mass flow for the base configuration and for embodiment 3. Line 101 shows the relationship for the baseline configuration, and a turbo speed of 65 k rpm. Line 102 shows the relationship for the baseline configuration, and a turbo speed of 95 k rpm. Line 131 shows the relationship for embodiment 3, and a turbo speed of 65 k rpm. Line 132 shows the relationship for the embodiment 3, and a turbo speed of 95 k rpm. It can be seen that the pressure ratio is hardly different between embodiment 3 and the baseline configuration.

FIG. 7(*b*) shows the efficiency as a function of corporate mass flow for the base configuration and for embodiment 3. Line 201 shows the relationship for the baseline configuration, and a turbo speed of 65 k rpm. Line 202 shows the relationship for the baseline configuration, and a turbo speed of 95 k rpm. Line 231 shows the relationship for embodiment 3, and a turbo speed of 65 k rpm. Line 232 shows the relationship for embodiment 3, and a turbo speed of 95 k rpm. It can be seen that for low flow rates, and for high flow rates at the high turbo speed (95 k rpm), the baseline configuration and embodiment 3 have similar levels of efficiency. At the low turbo speed (65 k rpm), embodiment 3 is much more efficient than the baseline configuration for high flow rates.

In summary, the embodiment 3 has efficiency improvement through the maps (though to a small extent at very high turbo speeds), whereas embodiments 1 and 2 only exhibit efficiency improvement at the low turbo speeds. On the other hand, for low turbo speeds, embodiments 1 and 2 show the greatest levels of efficiency improvement for high mass flow rates. All embodiments are more significantly more efficient than the baseline configuration at low turbo speed (about 65 k rpm) and high mass flow.

Compared to the embodiments, the baseline configuration has a smaller diffusion length for flow mixing, but the diffusion process begins earlier (that is, at a radially inward position). The embodiments, by contrast, have an extended diffusion length for flow mixing, and the diffusion process is delayed. These factors produce better performance, especially at low speed.

Although only a few embodiments of the diffuser have been described, many variations are possible within the scope of the invention as will be clear to a skilled reader.

The invention claimed is:

1. A compressor for a turbomachine, the compressor comprising:

a housing defining an inlet, an outlet and a compressor chamber;

a compressor wheel mounted within the compressor chamber for rotation about a rotational axis, the compressor wheel having a plurality of blades;

the housing defining:

a scroll radially outward of the compressor chamber and communicating with the outlet of the housing; and a diffuser space between an radially-extending shroud surface of the housing and a radially-extending hub surface, the diffuser space having an inlet communicating with the compression chamber and an outlet into the scroll, the diffuser space being rotationally symmetric about the axis, the diffuser space having:

a throat portion where the diffuser has minimum axial extent;

a radially-inner portion extending radially-inwardly from the throat portion, and throughout which the diffuser space has a greater axial extent than said minimum axial extent; and a radially-outer portion extending radially-outwardly from the throat portion to the scroll, and throughout which the diffuser space has a greater axial extent than said minimum axial extent;

the radially-outer edge of the radially-inner portion of the diffuser space being at a radial distance from the rotational axis which is no less than 125% of the radius of the compressor wheel; and the radially-inner edge of the radially-outer portion of the diffuser space being at a radial distance from the rotational axis which is no more than 140% of the radius of the compressor wheel.

2. A compressor according to claim 1 in which the radially-outer edge of the radially-inner portion of the diffuser space is at a distance from the rotation axis which is no less than 130% of the radius of the compressor wheel.

3. A compressor according to claim 1 in which the radially-outer edge of the radially-inner portion of the diffuser space is at a distance from the rotation axis which is no less than 140% of the radius of the compressor wheel.

4. A compressor according to claim 1 in which, at the radially-outer edge of the radially-outer portion of the diffuser space, the hub surface has a tangent perpendicular to the circumferential direction, which is at an angle of less than 90 degrees to the axial direction.

5. A compressor according to claim 1 in which the ratio of the distance from the rotational axis to the radially-inner edge of the radially-outer portion, to the distance from the rotational axis to the radially-outer edge of the radially-outer portion is in the range 75% to 90%.

6. A compressor according to claim 1 in which the axial extent of the diffuser space at the throat position is at least 65% of the axial extent of the blades at their radially-outer ends.

7. A compressor according to claim 1 in which the axial extent of the diffusion space increases in the radially-outward direction throughout the radially-outer portion.

8. A compressor according to claim 1 in which the axial extent of the diffusion space increases in the radially-inner direction throughout the radially-inner portion, and the radially-inner portion extends inwardly to a position which is spaced from the rotational axis by at most 110% of the radius of the compressor wheel.

9. A compressor according to claim 1 in which the throat portion has no radial extent.

10. A compressor according to claim 1 in which, between the compressor wheel and the scroll, the shroud wall is non-concave as viewed in a plane including the axis.

11. A compressor according to claim 10 in which, between the compressor wheel and the scroll, the shroud wall is convex as viewed in a plane including the axis.

12. A compressor according to claim 1 in which, at the radially-outer edge of the radially-outer portion of the diffuser space, the hub surface has a tangent perpendicular to the circumferential direction which is at an angle of no more than 80 degrees to the axial direction.

13. A compressor according to claim 1 in which the ratio of the distance from the rotational axis to the radially-inner edge of the radially-outer portion, to the distance from the rotational axis to the radially-outer edge of the radially-outer portion is less than 85%.

14. A turbocharger including a compressor, the compressor comprising:

a housing defining an inlet, an outlet and a compressor chamber;

a compressor wheel mounted within the compressor chamber for rotation about a rotational axis, the compressor wheel having a plurality of blades;

the housing defining:

a scroll radially outward of the compressor chamber and communicating with the outlet of the housing; and a diffuser space between an radially-extending shroud surface of the housing and a radially-extending hub surface, the diffuser space having an inlet communicating with the compression chamber and an outlet into the scroll, the diffuser space being rotationally symmetric about the axis, the diffuser space having:

a throat portion where the diffuser has minimum axial extent;

a radially-inner portion extending radially-inwardly from the throat portion, and throughout which the diffuser space has a greater axial extent than said minimum axial extent; and a radially-outer portion extending radially-outwardly from the throat portion to the scroll, and throughout which the diffuser space has a greater axial extent than said minimum axial extent;

the radially-outer edge of the radially-inner portion of the diffuser space being at a radial distance from the rotational axis which is no less than 125% of the radius of the compressor wheel; and the radially-inner edge of the radially-outer portion of the diffuser space being at a radial distance from the rotational axis which is no more than 140% of the radius of the compressor wheel.

* * * * *